US005737000A

United States Patent [19]

Shibata et al.

[11] Patent Number: 5,737,000

[45] Date of Patent: Apr. 7, 1998

[54] INK JET HEAD WITH POLYCRYSTALLINE METAL ELECTRODES

[75] Inventors: Hiroshi Shibata; Shin-ichiro Kaneko; Takashi Kubara, all of Fukuoka; Seishi Tomari, Onojo; Naoto Yoshida, Fukuoka; Hirofumi Kama, Kurume, all of Japan

[73] Assignee: Matsushita Electric Industrial Co., Ltd., Osaka, Japan

[21] Appl. No.: 443,023

[22] Filed: May 17, 1995

[30] Foreign Application Priority Data

May 20, 1994 [JP] Japan ..... 6-106570

[51] Int. Cl.[6] ..... B41J 2/05

[52] U.S. Cl. ..... 347/62; 347/63

[58] Field of Search ..... 347/58, 62, 63, 347/55, 64, 20, 56; 338/223, 226

[56] References Cited

U.S. PATENT DOCUMENTS 3,179,042 4/1965 Naiman .

5,479,197 12/1995 Fujikawa et al. ..... 347/63

5,509,558 4/1996 Imai et al. ..... 338/225

FOREIGN PATENT DOCUMENTS 615825A 1/1994 Japan .

*Primary Examiner*—N. Le

*Assistant Examiner*—L. Anderson

*Attorney, Agent, or Firm*—Watson Cole Stevens Davis, P.L.L.C.

[57] ABSTRACT

An ink-jet head for injecting ink into a work piece, has an ink passage in which the ink is received, and a pair of electrodes in the ink passage for heating electrically and vaporizing thermally the ink to generate an ink-jet toward the work piece, wherein a crystal grain diameter of the electrodes is not less than 0.1 μm, a total orientation deviation of (002) or (011) crystal orientation face of the electrodes with respect to a direction perpendicular to an electrode layer thickness direction is decreased, and/or a surface roughness of the electrodes is not less than 0.005 μm, so that oxidation and corrosion of the electrodes are restrained.

39 Claims, 5 Drawing Sheets

INK JET HEAD WITH POLYCRYSTALLINE METAL ELECTRODES

BACKGROUND OF THE INVENTION AND RELATED ART STATEMENT

The present invention relates to an ink jet head for a printing machine, particularly to an electrode contacting directly an ink or fluid to energize electrically the ink or fluid.

In a conventional ink-jet head as disclosed by U.S. Pat. No. 3,179,042, an electric current flows through an electrically conductive ink between a pair of electrodes to heat and vaporize the ink so that a vaporizing pressure urges the ink toward a workpiece.

OBJECT AND SUMMARY OF THE INVENTION

An object of the present invention is to provide an ink jet head in which electrochemical reaction of electrodes, for example, oxidation and/or corrosion thereof is restrained.

According to the present invention, an ink-jet head for injecting ink into a work piece comprises an ink passage in which the ink is received, and a pair of electrodes in the ink passage for heating electrically and vaporizing thermally the ink to generate an ink-jet toward the work piece, wherein the electrodes include polycrystalline metal facing to the ink to electrically energize the ink, and a crystal grain diameter of the polycrystalline metal is not less than 0.1 μm.

Since each of the electrodes includes the polycrystalline metal facing to the ink to electrically energize the ink, and the crystal grain diameter of the polycrystalline metal is not less than 0.1 μm according to the present invention, a surface area of the polycrystalline metal facing to the ink is kept large so that an electric current density between the polycrystalline metal and the ink is decreased to restrain the oxidation and corrosion of the electrodes. If the crystal grain diameter of the polycrystalline metal is less than 0.1 μm, a contacting area between crystal grains of the polycrystalline metal contacting with each other is large to decrease the surface area of the polycrystalline metal facing to the ink so that the electric current density between the polycrystalline metal and the ink is increased to accelerate the oxidation and corrosion of the electrodes.

At least one of partially-oxidized-film, oxide-film, partially-nitrided-film, nitride-film and corrosion-resistance-metal-film through which the polycrystalline metal or an electrode base metal faces to the ink may be formed at or cover tops of the polycrystalline metal grains or electrode base metal to further restrain the oxidation and corrosion of the electrodes. When the crystal grains of the polycrystalline metal are oxidized or nitrided to form the partially-oxidized-film, oxide-film, partially-nitrided-film or nitride-film thereof, it is preferable for the crystal grain diameter of the polycrystalline metal to be increased by less than about 1.3 times, particularly in a direction substantially perpendicular to an electrode thin layer thickness direction. When the crystal grains of the polycrystalline metal (electrode base metal) are covered by the film, it is preferable for the film to be arranged substantially only at tops of the crystal grains and to be restrained from being deposited significantly at side areas of the crystal grains other than the tops of thereof. It is preferable for the polycrystalline metal to be a hexagonal system metal or alloy.

When the polycrystalline metal is thin-layer-shaped and a layer thickness thereof is not less than 0.1 μm, the contacting area between crystal grains of the polycrystalline metal contacting with each other is kept small easily, that is, the surface area of the polycrystalline metal or electrode-surfaces facing to the ink is kept large. Where a main component of the polycrystalline metal is Ti, the crystal grain diameter of the polycrystalline metal can be easily kept not less than 0.1 μm.

When a surface roughness of the polycrystalline metal or electrode-surfaces facing to the ink is less than 0.005 μm, the surface area of the polycrystalline metal facing to the ink is decreased so that the electric current density between the polycrystalline metal and the ink is increased to accelerate the oxidation and corrosion of the electrodes.

When the metal facing directly to the ink, the electrode base metal facing to the ink through the at least one of partially-oxidized-film, oxide-film, partially-nitrided-film, nitride-film and corrosion-resistance-metal-film, or the polycrystalline or monocrystalline metal of electrodes is thin-layer-shaped, and a total orientation deviation of at least one of (002) and (011) crystal orientation face of the metal or electrode with respect to a direction substantially perpendicular to a thin layer thickness direction is smaller than a total orientation deviation of the at least one of (002) and (011) crystal orientation face of the metal or electrode with respect to the thin layer thickness direction, that is, an X-ray diffraction strength of at least one of (002) and (011) crystal orientation face of the crystal orientation ordered or controlled electrode thin layer surface or base metal (for example, heat-treated Ti thin layer on substrate in such a manner that the at least one of (002) and (011) crystal orientation face is urged or moved toward the direction substantially perpendicular to the thin layer thickness direction) is larger [preferably by (more than 1.2:1)] than that of a crystal orientation disordered or uncontrolled metal surface or base metal (for example, non-heat-treated Ti powder), showing that the at least one of (002) and (011) crystal orientation face is changed toward the direction substantially perpendicular to the thin layer thickness direction, mainly at least one of (002) and (011) crystal orientation face with a large resistibility against the oxidation and corrosion can face to the ink.

It is preferable that the at least one of partially-oxidized-film, oxide-film, partially-nitrided-film, nitride-film and corrosion-resistance-metal-film on the polycrystalline metal electrode base is prevented from changing or being deposited on significantly the crystal grain diameter of the polycrystalline metal electrode base in the direction substantially perpendicular to the electrode thin layer thickness direction, for keeping spaces between the crystal grains of the electrodes sufficiently large.

It is preferable that at least one component of the metal electrode base is identical with that of the at least one of partially-oxidized-film, oxide-film, partially-nitrided-film, nitride-film and corrosion-resistance-metal-film on the metal electrode base. A number of valence electrons of another component of the polycrystalline metal may be not less than five.

When the partially-oxidized-film has an oxidized portion through which an electric current is allowed to flow in a direction and is not allowed to flow in the reverse direction, the oxide-film is electrically semi-conductiveor conductive, the corrosion-resistance-metal-film is included by platinum group, the electrode base metal is thin-layer-shaped on which one of the partially-oxidized-film, oxide-film and corrosion-resistance-metal-film is arranged, it is preferable that a thickness of the one of partially-oxidized-film, oxide-film and corrosion-resistance-metal-film in a thin layer thickness direction is between 0.05 μm and 0.5 μm. When the electrode base metal is thin-layer-shaped on which one of the oxide-film and nitride-film is arranged, and a main component of the one of the oxide-film and nitride-film is Ti, it is preferable that a thickness of the one of the oxide-film and nitride-film in a thin layer thickness direction is between 0.01 μm and 1.0 μm.

A main component of the partially-oxidized-film may be any one selected from the group consisting of Ti, Ta, Nb, Zr, Hf, V, Mo and W. A main component of the oxide-film may be any one selected from the group consisting of Cu, Sn and Pb. A main component of the corrosion-resistance-metal-film may be any one selected from the group consisting of Pt, Pd, Ir and Rh.

DETAILED DESCRIPTION OF PREFERRED EMBODIMENTS

Figure 1:
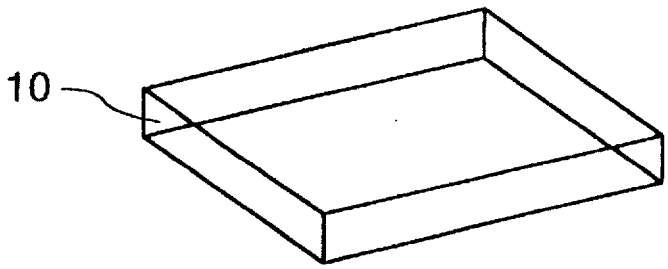
FIGS. 1–9 are obliquely projection views showing a method for producing an ink jet head according to the present invention.
Figure 2:
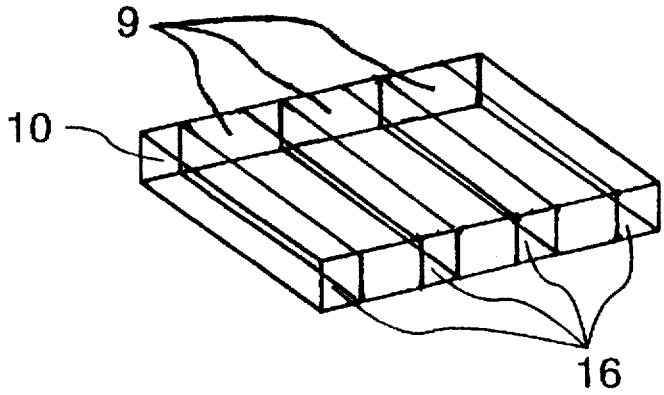
Figure 3:
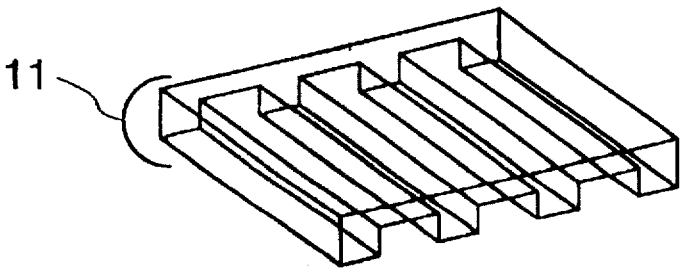
Figure 4:
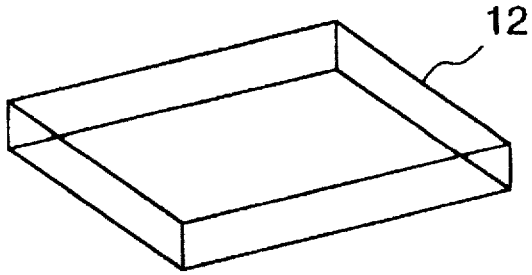
Figure 5:
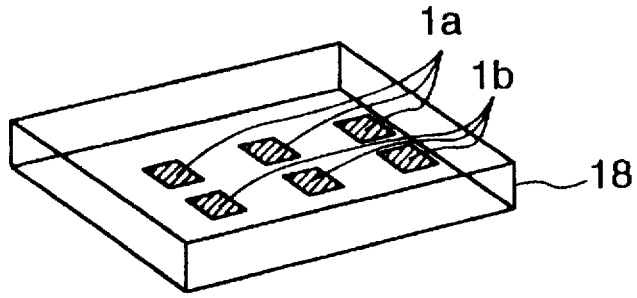
Figure 6:
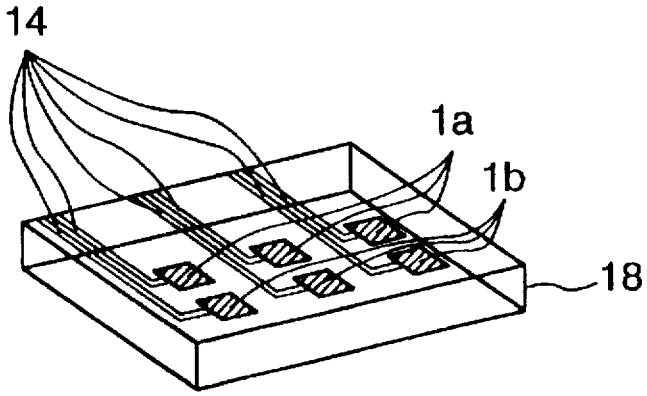
Figure 7:
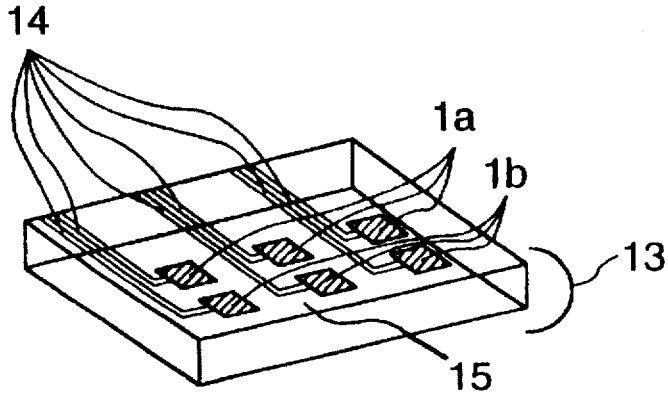
Figure 8:
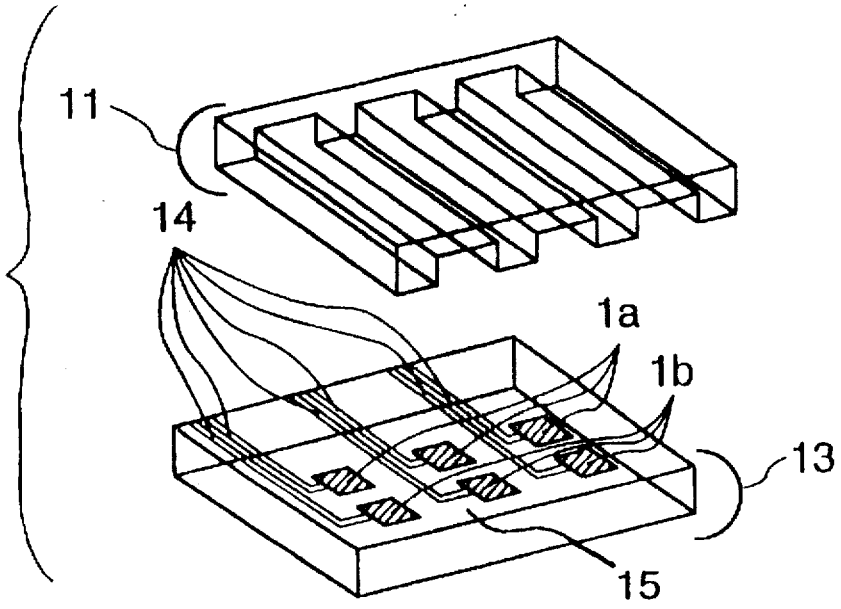
Figure 9:
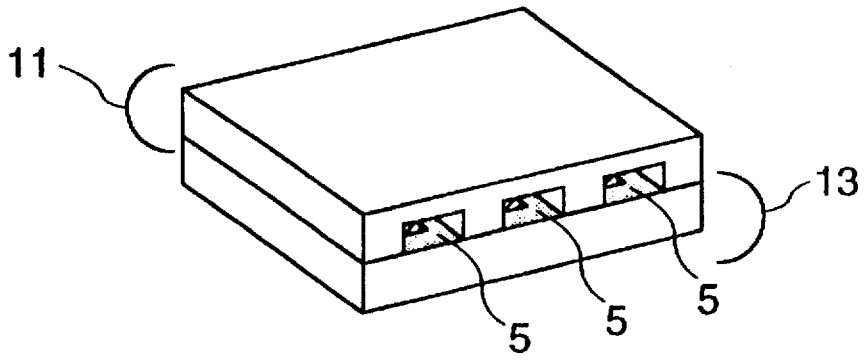

As shown in FIGS. 1–3, ultraviolet rays are applied to portions 9 to be converted to grooves in a photosensitive glass 10, and the photosensitive glass 10 is heat treated under 400° C. during 1 hour to crystallize the portions 9. The crystallized portions 9 are etched by 5% hydrofluoric solution to be converted to the grooves so that an ink passage substrate 11 is formed. As shown in FIGS. 4–7, a monocrystalline-and-surface-oxidized-sil or glass substrate 12 with a mirror surface thereon is prepared, electrodes 1*a*, 1*b* (size: 20 μm×40 μm, distance: 5 μm) and Au wires 14 are formed on the mirror surface through photolithography-etching process, and a photosensitive-resin insulating layer 15 (thickness: 3 μm, material: polyimid) is left on an area other than the electrodes 1*a*, 1*b* by the photolithography-etching process, so that an electrode substrate 13 is formed. Finally, as shown in FIGS. 8 and 9, the ink passage substrate 11 and the electrode substrate 13 are joined with adhesive or the like to form ink passages 5 into which an electrically conductive ink is supplied.

Figure 10:
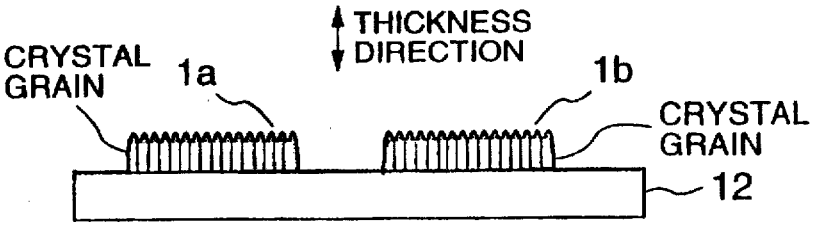
FIG. 10 is a schematic view showing crystal grains of polycrystalline metal for an electrode or electrode base metal.
Figure 16:
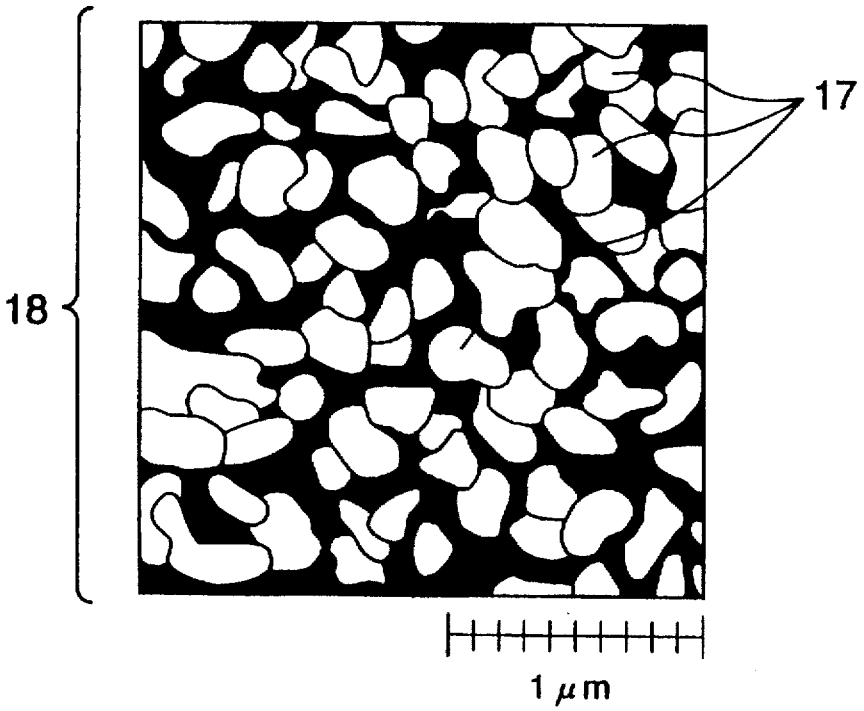
FIG. 16 is a schematic view of the polycrystalline metal seen in the thin layer thickness direction, showing spaces between the crystal grains for contacting with an ink.

In an embodiment of electrodes of the present invention as shown in FIG. 10, a diameter of crystal grains of polycrystalline metal, for example, Ti of the electrodes 1*a*, 1*b* is limited substantially to 0.1–1.0 μm, and/or a surface roughness of electrode upper surface is limited substantially to 0.005–0.1 μm. As shown in FIG. 16, crystal grains 17 of a polycrystalline metal electrode thin layer surface 18 form spaces therebetween as seen in a thin layer thickness direction to increase contacting area between the crystal grains 17 and the ink. For example, the diameter of the crystal grains of the polycrystalline metal electrode thin layer surface 18 (the claimed diameter of crystal grains) is an average value of maximum diameters of the crystal grains 17 as seen in the thin layer thickness direction within a predetermined area (for example, 5 μm×5 μm).

For example, the surface roughness of electrode upper surface is a center line average height of the electrode thin layer surface 18 measured by, for example, a scanning-type interatomic-force microscope, or scanning-type tunnel microscope within a predetermined area (for example, 5 μm×5 μm).

A thickness of the polycrystalline metal electrode thin layer 1*a*, 1*b* is limited substantially to 0.1–5.0 μm. When the thickness thereof is less than 0.1 μm, the spaces between the crystal grains 17 is small to keep the contacting area between the crystal grains 17 and the ink sufficiently large. When the thickness thereof is more than 0.1 μm, a shape of the electrode thin layer 1*a*, 1*b* cannot be formed correctly.

The polycrystalline metal electrode thin layer 1*a*, 1*b* may be formed by, for example, DC sputtering process using purity not less than 99.9% Ti under gas pressure not less than 20 mtorr and substrate temperature not less than 250° C., RF sputtering process, Ion-plating process, CVD process or the like.

TABLE 1

| | Process condition | Crystal grain diameter (μm) | Surface roughness (μm) | Obtained injection times (dots) |
|---|---|---|---|---|
| Present invention | 20 mtorr, 250° C. | 0.05 | 0.005 | 100,000,000 |
| | 20 mtorr, 350° C. | 0.1 | 0.008 | 100,000,000 |
| | 50 mtorr, 250° C. | 0.5 | 0.03 | 200,000,000 |
| | 50 mtorr, 350° C. | 0.9 | 0.09 | 200,000,000 |
| Comparison sample | 10 mtorr, 200° C. | 0.05 | 0.003 | 50,000,000 |
| | wire | not less than 1.0 | 0.001 | 10,000,000 |
| | wire | not less than 1.0 | not less than 0.1 | 10,000,000 |
| | vacuum deposition | not less than 0.1 | 0.003 | 10,000,000 |

Table 1 shows experimental results of relations among the crystal grain diameters, the surface roughnesses, and obtained ink injection times within each of which a variation of dot sizes by the ink jets injected into a workpiece is limited to ±30% of an original dot size obtained at a first injection, when the electrically conductive ink with 20 Ωcm resistivity is electrically energized by alternating current of 20 V and 3 MHz between the electrodes for induction heating, and the thickness of the electrodes is about 1–2 μm. The crystal grain diameter and the surface roughness are controlled by varying process condition for producing the polycrystalline metal electrode thin layer, that is, varying deposition process, the gas pressure and the substrate temperature as shown therein. The surface roughness may be controlled by varying a surface roughness of the glass substrate, or etching the surfaces of the electrodes with hydrofluoric or nitric-acid solution, or the like.

As shown in Table 1, the obtained ink injection times by the electrodes with the crystal grain diameter of 0.1–1.0 μm or the surface roughness of 0.005–0.1 μm are not less than 100,000,000, and the obtained ink injection times by the electrodes with the crystal grain diameter of 0.1–1.0 μm and the surface roughness of 0.005–0.1 μm are not less than 200,000,000, but the obtained ink injection times by the electrodes without the crystal grain diameter of 0.1–1.0 μm or the surface roughness of 0.005–0.1 μm are less than a desirable degree. An appropriate adjustment of the crystal grain diameter and/or the surface roughness causes an increase of contacting area between the electrodes and the ink so that a current density and/or differential voltage therebetween for heating the ink can be decreased. Therefore, the obtained ink injection time is increased significantly.

Figure 11:
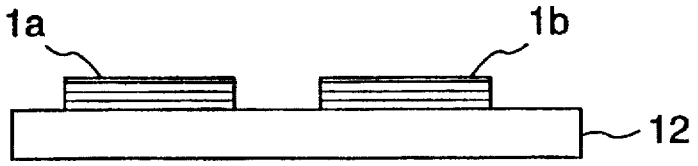
FIG. 11 is a schematic view showing a metal whose (002) crystal orientation face is changed toward a direction substantially perpendicular to a thin layer thickness direction for the electrode or electrode base metal.
Figure 12:
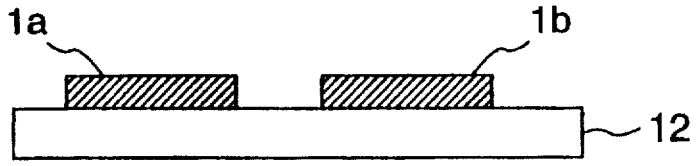
FIG. 12 is a schematic view showing a metal whose (011) crystal orientation face is changed toward a direction substantially perpendicular to a thin layer thickness direction for the electrode or electrode base metal.

As shown in FIGS. 11 and 12, when a total orientation deviation of at least one of (002) and (011) crystal orientation face of the polycrystalline or monocrystalline thin layer electrodes 1*a*, 1*b* with respect to a direction substantially perpendicular to a thin layer thickness direction is smaller than a total orientation deviation of the at least one of (002) and (011) crystal orientation face of the polycrystalline or monocrystalline thin layer electrodes 1*a*, 1*b* with respect to the thin layer thickness direction, that is, an X-ray diffraction strength of at least one of (002) and (011) crystal orientation face of the crystal orientation ordered or controlled polycrystalline or monocrystalline thin layer electrodes 1*a*, 1*b* (for example, heat-treated Ti thin layer on substrate in such a manner that the at least one of (002) and (011) crystal orientation face is urged or moved toward the direction substantially perpendicular to the thin layer thickness direction) is larger than that of a crystal orientation disordered or uncontrolled metal (for example, non-heat-treated Ti powder), showing that the at least one of (002) and (011) crystal orientation face is changed toward the direction substantially perpendicular to the thin layer thickness direction, the at least one of (002) and (011) crystal orientation face with a large resistibility against the oxidation and corrosion can mainly face to the ink, so that the oxidation and/or corrosion of the polycrystalline or monocrystalline thin layer electrodes 1*a*, 1*b* is prevented or restrained effectively. This effect by the crystal orientation face deviation control can be obtained irrespective of whether the thin layer electrodes are polycrystalline or monocrystalline, the crystal grain diameter and/or the surface roughness. The X-ray diffraction strength is measured by θ–2θ method of X-ray diffractometer.

TABLE 2

| | Controlled crystal orientation face | Crystal grain diameter (μm) | Surface roughness (μm) | Obtained injection times (dots) |
|---|---|---|---|---|
| Present invention | (1) (002) | 0.05 | 0.002 | 100,000,000 |
| | (2) (011) | 0.05 | 0.002 | 100,000,000 |
| Comparison sample | (1) uncontrolled | 0.05 | 0.003 | 50,000,000 |
| | (2) (110) | 0.05 | 0.002 | 20,000,000 |

Table 2 shows experimental results of relations among deviation-controlled crystal orientation face, the surface roughness and the obtained injection times. Test samples for these experimental results measured when the ink with 20 Ωcm resistivity is electrically energized by 20 V and 3 MHz between the electrodes are polycrystalline Ti thin layer electrodes of thickness 1.0 μm formed by DC sputtering process under gas pressure of 10 mtorr and substrate temperature of 200° C. The crystal orientation face deviation is controlled by heat-treatment of the electrodes in vacuum. The total orientation deviation of (002) crystal orientation face with respect to the direction substantially perpendicular to the thin layer thickness direction is made by the heat-treatment between 400 and 550 (preferably 500 and 600) °C. for thirty minutes smaller than a total orientation deviation of the (002) crystal orientation face with respect to the thin layer thickness direction. The total orientation deviation of (011) crystal orientation face with respect to the direction substantially perpendicular to the thin layer thickness direction is made by the heat-treatment between 550 and 700 (preferably 600 and 700) °C. for thirty minutes smaller than a total orientation deviation of the (011) crystal orientation face with respect to the thin layer thickness direction. As apparent from Table 2, the obtained injection time is significantly improved by the crystal orientation face deviation control.

The crystal orientation face deviation control may be performed by epitaxy or vapor deposition onto a crystal-lattice-constant selected substrate whose crystal-lattice-constant is substantially equal to that of the electrodes, or epitaxy vapor deposition onto an anisotoropic surface roughness substrate. The crystal grain diameter control and the crystal orientation face deviation control may be combined with each other.

Figure 13:
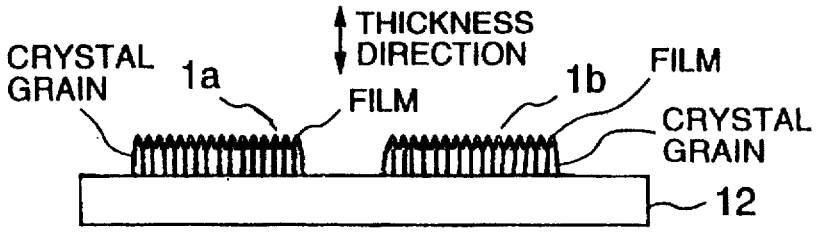
FIG. 13 is a schematic view showing crystal grains of polycrystalline metal for the electrode with at least one of partially-oxidized-film, oxide-film, partially-nitrided-film, nitride-film and corrosion-resistance-metal-film at tops of the crystal grains.
Figure 14:
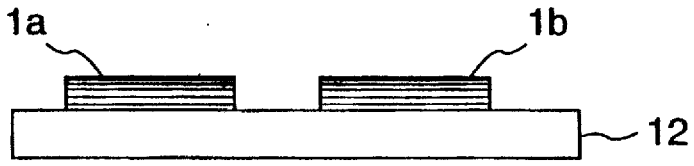
FIG. 14 is a schematic view showing a polycrystalline or monocrystalline metal whose (002) and/or (011) crystal orientation face is changed toward the direction substantially perpendicular to the thin layer thickness direction and which includes thereon the at least one of partially-oxidized-film, oxide-film, partially-nitrided-film, nitride-film and corrosion-resistance-metal-film thereon.
Figure 15:
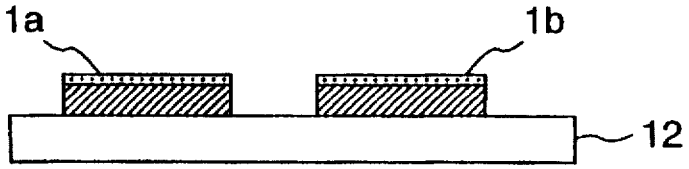
FIG. 15 is a schematic view showing a polycrystalline or monocrystalline metal with thereon the at least one of partially-oxidized-film, oxide-film, partially-nitrided-film, nitride-film and corrosion-resistance-metal-film whose (002) and/or (011) crystal orientation face is changed toward the direction substantially perpendicular to the thin layer thickness direction and which includes.

The polycrystalline or monocrystalline metal electrodes (electrode base metal) 1*a*, 1*b* after the crystal grain diameter control and/or the crystal orientation face deviation control may be covered by a film with thickness 0.05–0.5 μm of a valve metal (for example, Ti, Ta, Nb, Zr, Hf, V, Mo or W) which is partially oxidized to allow a current flow in a direction and prevent the current flow the reverse direction, an electrically conductive oxide (for example, Cu, Sn or Pb oxide), a corrosion-resistance-metal included by, for example, platinum group (for example, Pt, Pd, Ir or Rh), or a corrosion-resistance-alloy, for example, Ir-Ta alloy and Ir-Ti alloy, as shown in FIGS. 13–15.

TABLE 3

| | Electrode structure | Obtained injection times (dots) |
|---|---|---|
| Present invention | (1) Ta/polycrystalline Ti thin layer | more than 300,000,000 |
| | (2) $RuO_2$/polycrystalline Ti thin layer | more than 300,000,000 |
| | (3) Pt/polycrystalline Ti thin layer | more than 300,000,000 |
| | (4) Ta/(002) crystal orientation face | more than 200,000,000 |
| | (5) $RuO_2$/(002) crystal orientation face | more than 200,000,000 |
| | (6) Pt/(002) crystal orientation face | more than 200,000,000 |
| | (7) Ta/(011) crystal orientation face | more than 200,000,000 |
| | (8) $RuO_2$/(011) crystal orientation face | more than 200,000,000 |
| | (9) Pt/(011) crystal orientation face | more than 200,000,000 |
| Comparison sample | (1) polycrystalline Ti thin layer | 200,000,000 |
| | (2) (002) Ti thin layer | 100,000,000 |
| | (3) (011) Ti thin layer | 100,000,000 |

Table 3 shows experimental results of relations between films covering with thickness 0.2 μm the metal electrodes (electrode base metals) and the obtained injection times. The electrode base metals for these experimental results measured when the ink with 20 Ωcm resistivity is electrically energized by 20 V and 3 MHz between the electrodes are the polycrystalline Ti thin layer formed by DC sputtering process under gas pressure of 50 mtorr and substrate temperature of 350° C. Each of Ta of valve metal and $RuO_2$ of electrically conductive oxide is arranged on the electrode base metals by RF sputtering process, and Pt of corrosion-resistance-metal is arranged on the electrode base metals by the vacuum deposition.

These films protect the electrode base metals to restrain the oxidation and/or corrosion thereof by the ink. The valve metal may be arranged on the electrode base metals by the vapor deposition, and the electrically conductive oxide and corrosion-resistance-metal may be arranged on the electrode base metals by thermal decomposition process in the atmosphere. When the thickness of the film is less than 0.05 μm, the improvement for the oxidation and/or corrosion resistance is insufficient. When the thickness of the film is more than 0.5 μm, the improvement for the oxidation and/or corrosion resistance by the crystal grain diameter control and/or the crystal orientation face deviation control is not provided.

Tops of the polycrystalline or monocrystalline metal electrodes 1*a*, 1*b* after the crystal grain diameter control and/or the crystal orientation face deviation control may be oxidized or nitrided by thickness 0.01–1.0 μm. When the thickness of the oxidized or nitrided film is less than 0.01 μm, the improvement for the oxidation and/or corrosion resistance is insufficient. When the thickness of the oxidized or nitrided film is more than 1.0 μm, an current consumption for heating and vaporizing the ink is increased significantly. The oxidation is performed by, for example, anodizing. The nitriding is performed by, for example, heating in a gas including nitrogen. Since resistivity of the oxidized film is larger than that of the nitrided film, the nitriding is preferable for producing the protecting film on the electrode.

The polycrystalline or monocrystalline electrode metal or electrode base metal may be an Ti alloy including a component, for example, Nb, Ta, W, Sb or the like whose number of valence electrons is not less than five, or any one selected from the platinum group.

The above described metals may be applied to an optical element, a bioreactor, an electronic element, a photoelectric element, a cosmetic element, a catalyst agent, a photocatalyst, a catalyst agent carrier, an absorbent, an ultraviolet absorbent or the like, that is, the present invention's electrodes or electrode base metals are preferable for directly contacting various fluids to electrically energize them with preventing the oxidation and/or corrosion of the electrodes or electrode base metals.

What is claimed is:

1. An ink-jet head for injecting ink into a work piece, comprising:

an ink passage for receiving the ink; and a plurality of electrodes disposed in the ink passage for heating electrically and vaporizing thermally the ink to generate an ink-jet toward the work piece, wherein:

each of the plurality of electrodes includes a polycrystalline metal disposed to face the ink to electrically energize the ink, and a crystal grain diameter of the polycrystalline metal is not less than 0.1 μm.

2. An ink-jet head according to claim 1, wherein said each of the plurality of electrodes further comprises at least one of a partially-oxidized-film, an oxide-film, a partially-nitrided-film, a nitride-film and a corrosion-resistant-metal-film through which the polycrystalline metal faces the ink.

3. An ink-jet head according to claim 2, wherein at least one component of the polycrystalline metal is identical with a component of the at least one of said partially-oxidized-film, said oxide-film, said partially-nitrided-film, said nitride-film and said corrosion-resistant-metal-film.

4. An ink-jet head according to claim 2, wherein the partially-oxidized-film has an oxidized portion through which an electric current is allowed to flow in a single direction, the oxide-film is electrically conductive, the corrosion-resistant-metal-film is included by platinum group, the polycrystalline metal is as a layer on which one of the partially-oxidized-film, the oxide-film and the corrosion-resistant-metal-film is arranged, and a thickness of the one of the partially-oxidized-film, the oxide-film and the corrosion-resistant-metal-film in a direction of the layer thickness of the polycrystalline metal is between 0.05 μm and 0.5 μm.

5. An ink-jet head according to claim 2, wherein the polycrystalline metal has one of the oxide-film and the nitride-film arranged thereon, a main component of the one of the oxide-film and the nitride-film is Ti, and a thickness of the one of the oxide-film and the nitride-film in a direction of the layer thickness of the polycrystalline metal is between 0.01 μm and 1.0 μm.

6. An ink-jet head according to claim 2, wherein a main component of the partially-oxidized-film is selected from the group consisting of Ti, Ta, Nb, Zr, Hf, V, Mo and W.

7. An ink-jet head according to claim 2, wherein a main component of the oxide-film is selected from the group consisting of Cu, Sn and Pb.

8. An ink-jet head according to claim 2, wherein a main component of the corrosion-resistance-metal-film is selected from the group consisting of Pt, Pd, Ir and Rh.

9. An ink-jet head according to claim 1, wherein the crystal grain diameter of the polycrystalline metal is not more than 1.0 μm.

10. An ink-jet head according to claim 1, wherein a layer thickness of the polycrystalline metal is not less than 0.1 μm.

11. An ink-jet head according to claim 1, wherein a main component of the polycrystalline metal is Ti.

12. An ink-jet head according to claim 11, wherein the polycrystalline metal further comprises a second component having a number of valence electrons which is not less than five.

13. An ink-jet head according to claim 1, wherein a surface roughness of the polycrystalline metal is not less than 0.005 μm.

14. An ink-jet head according to claim 1, wherein a total orientation deviation of at least one of (002) and (011) crystal orientation faces of the polycrystalline metal with respect to a direction substantially perpendicular to a layer thickness direction of the polycrystalline metal is smaller than a total orientation deviation of the at least one of the (002) and (011) crystal orientation faces of the polycrystalline metal with respect to the layer thickness direction.

15. An ink-jet head according to claim 1, further comprising a first substrate having a groove thereon, and a second substrate having the plurality of electrodes thereon, the first and second substrates being joined such that the groove forms the ink passage.

16. An ink-jet head according to claim 1, further comprising:

a first substrate having a plurality of grooves therein; and a second substrate having the plurality of electrodes thereon, at least two of the plurality of electrodes being disposed to face each of the plurality of grooves;

the first substrate and the second substrate being joined so that the plurality of grooves form the ink passage.

17. An ink-jet head according to claim 16, wherein the second substrate comprises a material selected from the group consisting of (i) monocrystalline silicon and (ii) glass.

18. An ink-jet head according to claim 17, wherein the monocrystalline silicon is surface oxidized.

19. An ink-jet head for injecting ink into a work piece, comprising:

an ink passage for receiving the ink; and a plurality of electrodes disposed in the ink passage for heating electrically and vaporizing thermally the ink to generate an ink-jet toward the work piece, wherein:

each of the plurality of electrodes includes a polycrystalline metal having a surface facing to the ink, and a surface roughness of the surface of said each of the plurality of electrodes is not less than 0.005 μm.

20. An ink-jet head according to claim 19, wherein the surface of said each of the plurality of electrodes includes at least one of a partially-oxidized-film, an oxide-film, a partially-nitrided-film, a nitride-film and a corrosion-resistant-metal-film thereon.

21. An ink-jet head according to claim 20, wherein said each of the electrodes has a base metal, and at least one component of the base metal is identical with a component of the at least one of the partially-oxidized-film, the oxide-film, the partially-nitrided-film, the nitride-film and the corrosion-resistant-metal-film.

22. An ink-jet head according to claim 20, wherein the partially-oxidized-film has an oxidized portion through which an electric current is allowed to flow in a single direction, the oxide-film is electrically conductive, the corrosion-resistant-metal-film comprises a platinum group metal, and a thickness of the one of the partially-oxidized-film, the oxide-film and the corrosion-resistant-metal-film in a layer thickness direction of said each of the plurality of electrodes is between 0.05 μm and 0.5 μm.

23. An ink-jet head according to claim 20, wherein said each of the plurality of electrodes has one of the oxide-film and the nitride-film arranged thereon, wherein a main component of the one of the oxide-film and the nitride-film is Ti, and a thickness of the one of the oxide-film and the nitride-film in a layer thickness direction of said each of the plurality of electrodes is between 0.01 μm and 1.0 μm.

24. An ink-jet head according to claim 20, wherein a main component of the partially-oxidized-film is selected from the group consisting of Ti, Ta, Nb, Zr, Hf, V, Mo and W.

25. An ink-jet head according to claim 20, wherein a main component of the oxide-film is selected from the group consisting of Cu, Sn and Pb.

26. An ink-jet head according to claim 20, wherein a main component of the corrosion-resistance-metal-film is selected from the group consisting of Pt, Pd, Ir and Rh.

27. An ink-jet head according to claim 19, wherein a total orientation deviation of at least one of (002) and (011) crystal orientation faces of said each of the plurality of electrodes with respect to a direction substantially perpendicular to a layer thickness direction of said each of the plurality of electrodes is smaller than a total orientation deviation of the at least one of the (002) and (011) crystal orientation faces with respect to the layer thickness direction.

28. An ink-jet head for injecting ink into a work piece, the ink-jet head comprising:

an ink passage for receiving the ink and a plurality of electrodes disposed in the ink passage for heating electrically and vaporizing thermally the ink to generate an ink-jet toward the work piece, wherein:

each of the plurality of electrodes is shaped as a layer with a layer thickness direction, and a total orientation deviation of at least one of (002) and (011) crystal orientation faces of the electrodes with respect to a direction substantially perpendicular to the layer thickness direction is smaller than a total orientation deviation of the at least one of (002) and (011) crystal orientation faces with respect to the thin layer thickness direction.

29. An ink-jet head according to claim 28, wherein each of the plurality of electrodes includes thereon at least one of a partially-oxidized-film, an oxide-film, a partially-nitrided-film, a nitride-film and a corrosion-resistant-metal-film facing to the ink.

30. An ink-jet head according to claim 29, wherein each of the electrodes comprises a metal, at least one component of the metal is identical with a component of the at least one of the partially-oxidized-film, the oxide-film, the partially-nitrided-film, the nitride-film and the corrosion-resistant-metal-film on the metal.

31. An ink-jet head according to claim 29, wherein the partially-oxidized-film has an oxidized portion through which an electric current is allowed to flow in a single direction, the oxide-film is electrically conductive, the corrosion-resistant-metal-film comprises a platinum group metal, each of the electrodes having one of the partially-oxidized-film, the oxide-film and the corrosion-resistant-metal-film arranged thereon is shaped as a layer, and a thickness of the one of the partially-oxidized-film, the oxide-film and the corrosion-resistant-metal-film in the layer thickness direction is between 0.05 μm and 0.5 μm.

32. An ink-jet head according to claim 29, wherein a main component of one of the oxide-film and the nitride-film is Ti, and a thickness of at least one of the oxide-film and the nitride-film in the layer thickness direction is between 0.01 μm and 1.0 μm.

33. An ink-jet head according to claim 29, wherein a main component of the partially-oxidized-film is selected from the group consisting of Ti, Ta, Nb, Zr, Hf, V, Mo and W.

34. An ink-jet head according to claim 29, wherein a main component of the oxide-film is selected from the group consisting of Cu, Sn and Pb.

35. An ink-jet head according to claim 29, wherein a main component of the corrosion-resistance-metal-film is selected from the group consisting of Pt, Pd, Ir and Rh.

36. An ink-jet head according to claim 28, wherein a layer thickness of said each of the plurality of electrodes is not less than 0.1 μm.

37. An ink-jet head according to claim 28, wherein main component of the plurality of electrodes is Ti.

38. An ink-jet head according to claim 37, wherein each of the plurality of electrodes further comprises a second component having a number of valence electrons which is not less than five.

39. An ink-jet head according to claim 28, further comprising a first substrate having a groove thereon, and a second substrate having the electrodes thereon, wherein the ink passage is formed by the first and second substrates.

* * * * *